US009482970B2

(12) United States Patent
Nauka et al.

(10) Patent No.: US 9,482,970 B2
(45) Date of Patent: Nov. 1, 2016

(54) ORGANIC PHOTOCONDUCTORS HAVING PROTECTIVE COATINGS WITH NANOPARTICLES

(75) Inventors: Krzysztof Nauka, Palo Alto, CA (US); Zhang-Lin Zhou, Palo Alto, CA (US); Lihua Zhao, Sunnyvale, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/373,581

(22) PCT Filed: Mar. 30, 2012

(86) PCT No.: PCT/US2012/031559

§ 371 (c)(1),
(2), (4) Date: Jul. 21, 2014

(87) PCT Pub. No.: WO2013/147864

PCT Pub. Date: Oct. 3, 2013

(65) Prior Publication Data

US 2014/0349227 A1 Nov. 27, 2014

(51) Int. Cl.
*G03G 5/147* (2006.01)

(52) U.S. Cl.
CPC ..... *G03G 5/14726* (2013.01); *G03G 5/147* (2013.01); *G03G 5/14704* (2013.01); *G03G 5/14786* (2013.01); *G03G 5/14791* (2013.01); *G03G 2215/00957* (2013.01)

(58) Field of Classification Search
CPC ..... G03G 5/14704; G03G 5/14734; G03G 5/14739; G03G 5/14726
USPC ..... 430/66, 58.7
See application file for complete search history.

(56) References Cited

U.S. PATENT DOCUMENTS

| | | | |
|---|---|---|---|
| 4,990,418 | A | 2/1991 | Mukoh et al. |
| 5,476,604 | A | 12/1995 | Nguyen et al. |
| 5,882,814 | A | 3/1999 | Fuller et al. |
| 6,068,957 | A | 5/2000 | Nair et al. |
| 6,326,111 | B1 | 12/2001 | Chambers et al. |
| 6,830,858 | B2 | 12/2004 | Sugino et al. |
| 6,902,857 | B2 | 6/2005 | Yagi et al. |
| 7,115,346 | B2 | 10/2006 | Yokota et al. |
| 7,122,283 | B2 | 10/2006 | Qi et al. |
| 7,132,208 | B2 | 11/2006 | Lee et al. |
| 7,361,438 | B2 | 4/2008 | Suzuki et al. |

(Continued)

FOREIGN PATENT DOCUMENTS

| | | |
|---|---|---|
| EP | 2028549 | 2/2009 |
| JP | H08262779 | 10/1996 |

(Continued)

OTHER PUBLICATIONS

PCT International Search Report, Nov. 30, 2012, Application No. PCT/US2012/031559 (filed Mar. 30, 2012).

*Primary Examiner* — Christopher Rodee
(74) *Attorney, Agent, or Firm* — HP Inc. Patent Department

(57) ABSTRACT

An organic photoconductor includes: a conductive substrate; a charge generation layer formed on the conductive substrate; a charge transport layer formed on the charge generation layer; and a protective coating formed on the charge transport layer. The protective coating comprises nanoparticles incorporated in an in-situ cross-linked polymer matrix. A process for increasing mechanical strength in an organic photoconductor is also provided.

12 Claims, 3 Drawing Sheets

(56) References Cited

U.S. PATENT DOCUMENTS

| | | | | |
|---|---|---|---|---|
| 7,413,835 | B2 | 8/2008 | Lin et al. | |
| 7,645,555 | B2 | 1/2010 | Lin et al. | |
| 7,691,931 | B2 | 4/2010 | Li et al. | |
| 7,709,168 | B2 | 5/2010 | Wu et al. | |
| 8,101,327 | B2 | 1/2012 | Tong et al. | |
| 2005/0233235 | A1* | 10/2005 | Qi | G03G 5/0614 430/58.2 |
| 2005/0238989 | A1 | 10/2005 | Kakui et al. | |
| 2005/0287452 | A1 | 12/2005 | Tamura et al. | |
| 2005/0287465 | A1 | 12/2005 | Ohshima et al. | |
| 2006/0286473 | A1 | 12/2006 | Kami | |
| 2007/0042281 | A1 | 2/2007 | Orito et al. | |
| 2007/0117033 | A1 | 5/2007 | Sugino et al. | |
| 2007/0166634 | A1 | 7/2007 | Qi et al. | |
| 2008/0145781 | A1* | 6/2008 | Tong | G03G 5/0535 430/270.1 |
| 2009/0035672 | A1 | 2/2009 | Yanagawa et al. | |
| 2009/0047588 | A1 | 2/2009 | Yanus et al. | |
| 2009/0053637 | A1 | 2/2009 | Lin et al. | |
| 2009/0092914 | A1 | 4/2009 | Wu et al. | |
| 2009/0148182 | A1 | 6/2009 | Watanabe et al. | |
| 2009/0185821 | A1* | 7/2009 | Iwamoto | G03G 5/0535 430/58.7 |
| 2010/0167193 | A1 | 7/2010 | Nukada et al. | |
| 2010/0215405 | A1 | 8/2010 | Patton et al. | |
| 2010/0260513 | A1 | 10/2010 | Kawasaki et al. | |
| 2010/0297543 | A1 | 11/2010 | Tong et al. | |
| 2011/0039197 | A1 | 2/2011 | Fujita et al. | |
| 2012/0003008 | A1 | 1/2012 | Nauka et al. | |

FOREIGN PATENT DOCUMENTS

| | | |
|---|---|---|
| JP | 9006035 | 1/1997 |
| JP | 09034154 | 2/1997 |
| JP | 2002311612 | 10/2002 |
| WO | WO-2010104513 | 9/2010 |
| WO | WO-2012115650 | 8/2012 |

* cited by examiner

ORGANIC PHOTOCONDUCTORS HAVING PROTECTIVE COATINGS WITH NANOPARTICLES

BACKGROUND

An organic photoconductor (OPC) is one of the components in an electrophotographic (EP) printer. A latent image, which is a surface charge pattern, is created on the OPC prior to contact with a development system containing charged marking particles. This is accomplished by uniformly charging the OPC surface, followed by selective illumination that locally generates opposite charges within the bulk of the OPC which then move to the surface and locally neutralize deposited charges. The OPC frequently has two layers: an inner layer for generating charges (charge generation layer—CGL) and an outer layer containing molecular moieties for facilitating charge movement (charge transport layer—CTL). In the ideal case, the OPC element has very uniform and defect-free structural and electrical characteristics. Its usable lifetime is often determined by the occurrence of physical defects introduced by mechanical, physicochemical, and electrical interactions between the surface of the CTL and one or more elements of the electrophotographic process (commonly known as "OPC wear-out"). Some of the proposed solutions addressing this issue involve coating the CTL surface with a hard, inorganic film that may significantly raise the OPC cost and introduce other deleterious effects associated with the contamination particles originating from the inorganic coating.

Alternative solutions have proposed coating the OPC with an organic coating having superior damage resistance and electrical properties corresponding to the original OPC. This might be accomplished by using a mixture of damage-resistant polymer (matrix) and molecular moieties (CTM—charge transport material) providing electrical charge conduction, and coating the original OPC with their solvent-based mixture. This solution has not been successful due to a lack of appropriate hole-conducting dopants that can be used with a solvent that does not attack the original OPC. All commonly-available hole-CTMs require solvents that are incompatible with the polymeric matrix components used for most of the commercial OPCs.

DETAILED DESCRIPTION

Figure 1A:
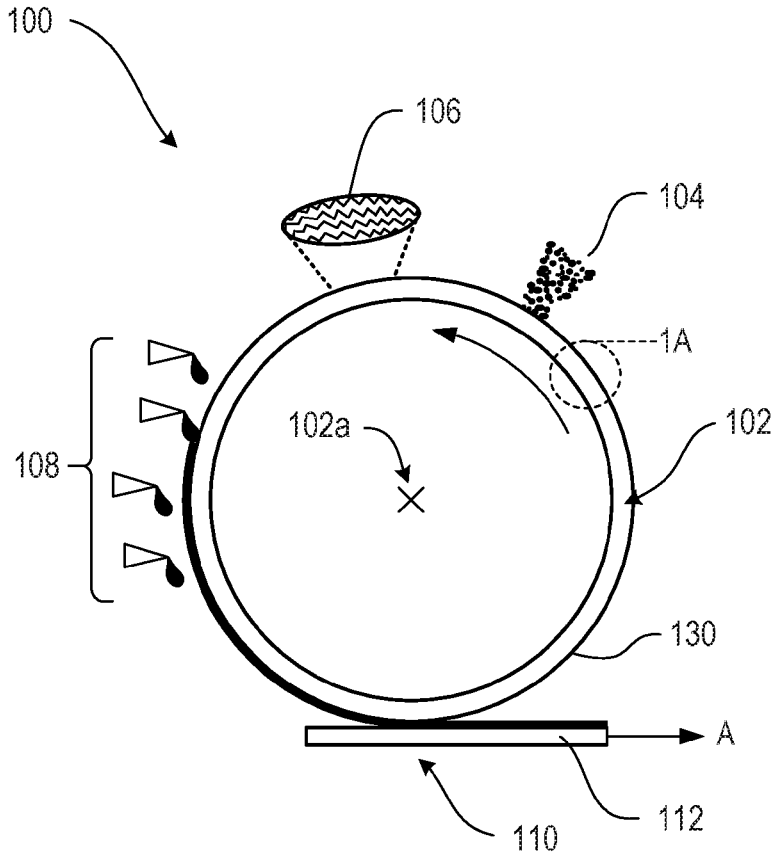
FIG. 1A is a schematic diagram of an apparatus that employs an example organic photoconductor (OPC) drum, in accordance with the teachings herein.

Reference is made now in detail to specific examples, which illustrate the best mode presently contemplated by the inventors for practicing the invention. Alternative examples are also briefly described as applicable.

It is to be understood that this disclosure is not limited to the particular process steps and materials disclosed herein because such process steps and materials may vary somewhat. It is also to be understood that the terminology used herein is used for the purpose of describing particular examples only. The terms are not intended to be limiting because the scope of the present disclosure is intended to be limited only by the appended claims and equivalents thereof.

It is noted that, as used in this specification and the appended claims, the singular forms "a," "an," and "the" include plural referents unless the context clearly dictates otherwise.

As used herein, "about" means a ±10% variance caused by, for example, variations in manufacturing processes.

As used herein, "alkyl" refers to a branched, unbranched, or cyclic saturated hydrocarbon group, which typically, although not necessarily, includes from 1 to 50 carbon atoms, or 1 to 30 carbon atoms, or 1 to 6 carbons, for example. Alkyls include, but are not limited to, methyl, ethyl, n-propyl, isopropyl, n-butyl, isobutyl, t-butyl, octyl, and decyl, for example, as well as cycloalkyl groups such as cyclopentyl, and cyclohexyl, for example.

As used herein, "aryl" refers to a group including a single aromatic ring or multiple aromatic rings that are fused together, directly linked, or indirectly linked (such that the different aromatic rings are bound to a common group such as a methylene or ethylene moiety). Aryl groups described herein may include, but are not limited to, from 5 to about 50 carbon atoms, or 5 to about 40 carbon atoms, or 5 to 30 carbon atoms or more. Aryl groups include, for example, phenyl, naphthyl, anthryl, phenanthryl, biphenyl, diphenylether, diphenylamine, and benzophenone. The term "substituted aryl" refers to an aryl group comprising one or more substituent groups. The term "heteroaryl" refers to an aryl group in which at least one carbon atom is replaced with a heteroatom. If not otherwise indicated, the term "aryl" includes unsubstituted aryl, substituted aryl, and heteroaryl.

As used herein, "substituted" means that a hydrogen atom of a compound or moiety is replaced by another atom such as a carbon atom or a heteroatom, which is part of a group referred to as a substituent. Substituents include, but are not limited to, for example, alkyl, alkoxy, aryl, aryloxy, alkenyl, alkenoxy, alkynyl, alkynoxy, thioalkyl, thioalkenyl, thioalkynyl, and thioaryl.

As used herein, "alcohol" means a lower alkyl chain alcohol, such as methanol, ethanol, n-propanol, iso-propanol, n-butanol, iso-butanol, tert-butanol, pentanol, hexanol, and their analogs.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

The organic photoconductor (OPC) in an electrophotographic printer is a thin film photoconductive multi-layer structure. An electrostatic latent image is formed on the precharged photoreceptor surface via optical exposure. A visual image is obtained after the electrostatic image is developed with charged color toner particles that are subsequently transferred to paper. After the toner is transferred to paper (or other print media), the photoreceptor needs to be cleaned abrasively and corona-charged with ions to get ready for the next imaging process.

An example of an electrophotographic (EP) printer that may employ an organic photoconductor (OPC) is depicted in FIG. 1A, which is a schematic diagram of portion of a generic EP printer. An EP printer 100 comprises an OPC drum 102 that is rotatable about an axis 102*a*. The construction of the OPC drum 102, which incorporates the teachings herein, is described in greater detail below.

As the OPC drum 102 rotates, it passes through several stations, including a charging station 104, an exposure station 106, a development station 108, and a transfer station 110.

At the charging station 104, an electrostatic charge is uniformly distributed over the surface of the OPC drum 102. Charging is typically done by a corona or a charge roller.

At the exposure station 106, also known as the image-forming station, the document to be printed or its image formed on a screen is illuminated and either passed over a lens or is scanned by a moving light and lens, such that its image is projected onto and synchronized with the moving drum surface. Where there is text or image on the document, the corresponding area of the drum remains unlit. Where there is no image, the drum is illuminated and the charge is dissipated. The charge that remains on the drum after this exposure is a "latent" image and is a negative of the original document.

At the development station 108, the drum 102 is presented with toner, e.g., liquid ink, more specifically, black ink in the case of a black ink-only printer and colored inks in the case of a color ink printer. The liquid ink is electrically charged and attracted to areas on the drum bearing complementary electrical charges.

At the transfer station 110, the ink on the drum 102 is transferred to a print medium 112, moving in the direction indicated by arrow A.

Following ink transfer, the drum 102 is prepared for a new imaging cycle.

Figure 1B:
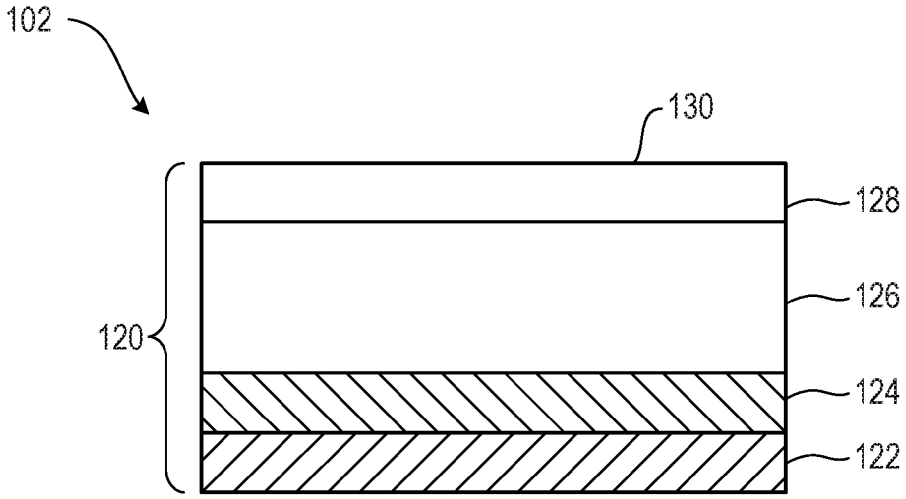
FIG. 1B is an enlargement of a portion of the OPC drum of FIG. 1A.

FIG. 1B is an enlargement of a portion of the drum 102 of FIG. 1A, and depicts an example configuration in accordance with the teachings herein. An OPC 120 may comprise a conductive substrate 122, a charge generation layer (CGL) 124, and a charge transport layer (CTL) 126. The thickness of the CTL 126 may be greater than 10 μm. A protective coating 128 may be formed on the exterior surface of the CTL 126. The protective coating 128 has a thickness in the range of 0.5 to 10 μm. The scratch resistance of the protective coating 128 may be improved by incorporation therein of the nanoparticles.

The structure of the organic photoreceptor usually has several layers of materials, each of which performs a specific function, such as charge generation, charge transport, and occasionally additional surface protection. These layers are formed by individual sequential coatings. One of these layers is the charge transport material (CTM) layer, or CTL 126. In this regard, mainly aromatic tertiary amino compounds and their corresponding polymers are usually used. Generally, these materials are soluble in common organic solvents such as tetrahydrofuran (THF) and dichloromethane ($CH_2Cl_2$). Because of their solubility in these solvents, there is usually a loss of charge transport material and/or mixing with the material that is over-coated on top for protection. In addition, these materials cannot facilitate "fast" transport of electrical charges, making them less desirable for the high-speed printing applications, such as digital commercial printing.

In the electrophotographic process, the photoreceptor (belt or cylinder) ideally has very uniform area characteristics: coating uniformity, dark conductivity, and photoconductivity. During each imaging cycle, the OPC surface is subjected to a number of punishing electrochemical and mechanical processes. These include corrosive ozone and oxidative reactions from corona or charge roller charging, abrasive mechanical treatments from toner development, toner transfer to paper, and doctor blade cleaning of the drum and contact with a charge roller. The essential physical properties that dictate the electrophotographic imaging process, such as dark and photo conductivity and electronic defects on the photoreceptor surface etc. would definitely accelerate their deterioration under such detrimental conditions. Therefore, it is desirable to develop protective overcoats for the OPCs.

In the case of liquid electrophotography, these processes can be further enhanced by interactions between the solvent (usually a non-polar, isoparaffinic-based mixture) and the polymer constituting the CTL. In many cases, solvent can penetrate into the CTL through openings caused by the mechanically damaged surface and can cause local swelling of the CTL. The CTL damage degrades print quality, resulting in frequent replacement of the OPC. Mechanical damage can be related to a high concentration of the molecular conducting moieties (small molecules) that in most cases can be as high as 50% of the CTL volume. Frequent photoconductor replacement can have a negative impact on the cost of the printing process, which is particularly important for high speed/large volume printing applications, as in the case of digital commercial printers.

Previous attempts to improve the operational lifetime of the OPC surface region have relied on coating it with a layer of a "hard" inorganic film, such as carbon (e.g., graphite or diamond), silica, etc. This solution is not popular due to the following reasons: a) difficulties in forming such inorganic film on the organic substrate (lack of compatible deposition processes); b) excessively high cost of the inorganic films and their poor reliability; and c) "dust" issues due to the fact that the inorganic coating may "shed" microscopic particles caused by the mechanical interactions with the print engine components and poor adhesion of the inorganic coating to an organic substrate.

On the other hand, the promising results of using organic solvent-based cross-linkable coatings with CTMs to extend the lifetime of OPC have been demonstrated. Their advantage stems from the fact that, due to their superior electrical conductivity, the desired electrical properties of the coating can be achieved at low CTM concentrations without compromising mechanical strength of the layer. However, most of the CTMs can only be dissolved into more aggressive solvents such as toluene, xylenes, THF, chloroform, chlorobenzene, and dichlorobenzene, etc. Unfortunately, all of these solvents can damage the existing CTL 126 in a commercial OPC. Polycarbonates used in the CTL 126 can survive only a few solvents such as alcohols, while essentially all of the commercially-available CTMs have very poor solubility in alcohols. Thus, the development of alcohol-soluble CTMs could permit a solution process to coat the OPC layer without damaging the polycarbonate layer.

More recent solutions have provided the charge transport layer of the OPC with a subsequently cross-linkable thin film that can significantly increase the OPC time-to-failure without degrading its printing performance. This improvement of the OPC lifetime is due to increased scratch resistance of the OPC coating as compared to scratch resistance of the original uncoated OPC.

These recent solutions include employing alcohol-soluble hole transport materials and coating the CTL 126 of the OPC with a solvent-based mixture containing monomer moieties which are cross-linked after deposition on the OPC. That is to say, the monomer is cross-linked in-situ on the surface of the OPC to provide the protective coating 128. This approach provides much better adhesion and higher mechanical strength layers than in the case where a previously cross-linked polymer is deposited on the OPC.

In accordance with the teachings herein, the improved OPC described immediately above is further improved by forming a protective coating on the charge transport layer. The protective coating includes controlled amounts of nanoparticles made of mechanically "hard" materials.

A significant increase of the mechanical strength, and corresponding scratch resistance, is achieved, as demonstrated for the case of printing using the HP Indigo 7000 press. This improvement is estimated to be of the order 5X to 30× based on the scratch test measurement, and is achieved without any degradation of the printing quality of changes to the printing procedure. Proposed improvement of the OPC lifetime can be achieved with a simple coating process using commercial coating processes and commercial coating materials. The overall cost of this coating improvement is of the order of few cents per OPC. Indeed, the enhancement of the OPC scratch resistance is applicable not only to future OPC components, but it can be introduced into present products immediately, thereby providing lowering of the cost per page (CPP) for already installed printers.

This effect can be accomplished using commercial inorganic nanoparticles that are functionalized to be compatible with the solvent used in mixing and deposition of the organic coating. For example, in coating the OPC with a subsequently cross-linkable thin film to form the CTL layer 126, isopropyl alcohol (IPA) is likely to be employed as the solvent, and IPA-dispersible, low cost inorganic nanoparticles are readily available from commercial vendors. The organic coating 128 may also be formed from alcohol-soluble monomers, cross-linkers, and initiators.

The nanoparticles employed in the practice of the teachings herein may be a material that will not interfere with the printing process. Such material may:

(1) be transparent in the visible range (so as not to interfere with optical writing), (2) have a size of the order of few hundred nm or less (easily miscible, will not separate from the surface of deposited film, if separated from the film, then small enough to be swept away into the cleaning stage of the printing apparatus), and (3) mechanically strong (above 10 on the Vickers hardness scale). Fortunately, the most common, low cost commercial nanoparticles of silicon oxide, silicon nitride, aluminum oxide, carbon nanoparticles ("buckyballs"), carbon nanotubes, and the like readily satisfy all these conditions.

The use of nanoparticles in a protective layer 128 has been demonstrated using an Indigo OPC. Four types of films were employed as set forth in Table I below:

TABLE I

| Designator | Layer | Thickness |
|---|---|---|
| (A) | non-coated OPC | — |
| (B) | coated OPC fabricated using a subsequently cross-linkable thin film | about 2.7 μm |
| (C) | coating as in (B) but containing 5% NVS* Si-oxide nanoparticles having average size of about 250 nm | about 2.7 μm |
| (D) | coating as in (C) but Si-oxide nanoparticle content was increased to 10% | about 2.7 μm |

Note:
*NVS = non-volatile solids

Scratch resistance was tested using a commercial Taber scratch tester in which the tested film is subjected to circular movement of a diamond-tipped needle having a prescribed height for a fixed time period. In the tests, the coating film was scratched for 1 min under a weight load between 10 g and 50 g, in 10 g increments. The depth of the scratch was then measured using a commercial Dektak profiler. The scratch depth is considered a measure of the film's scratch resistance; the less the scratch depth, the more scratch resistant the coating. The scratch load was selected to prevent the scratch depth from exceeding the coating layer thickness.

Figure 2:
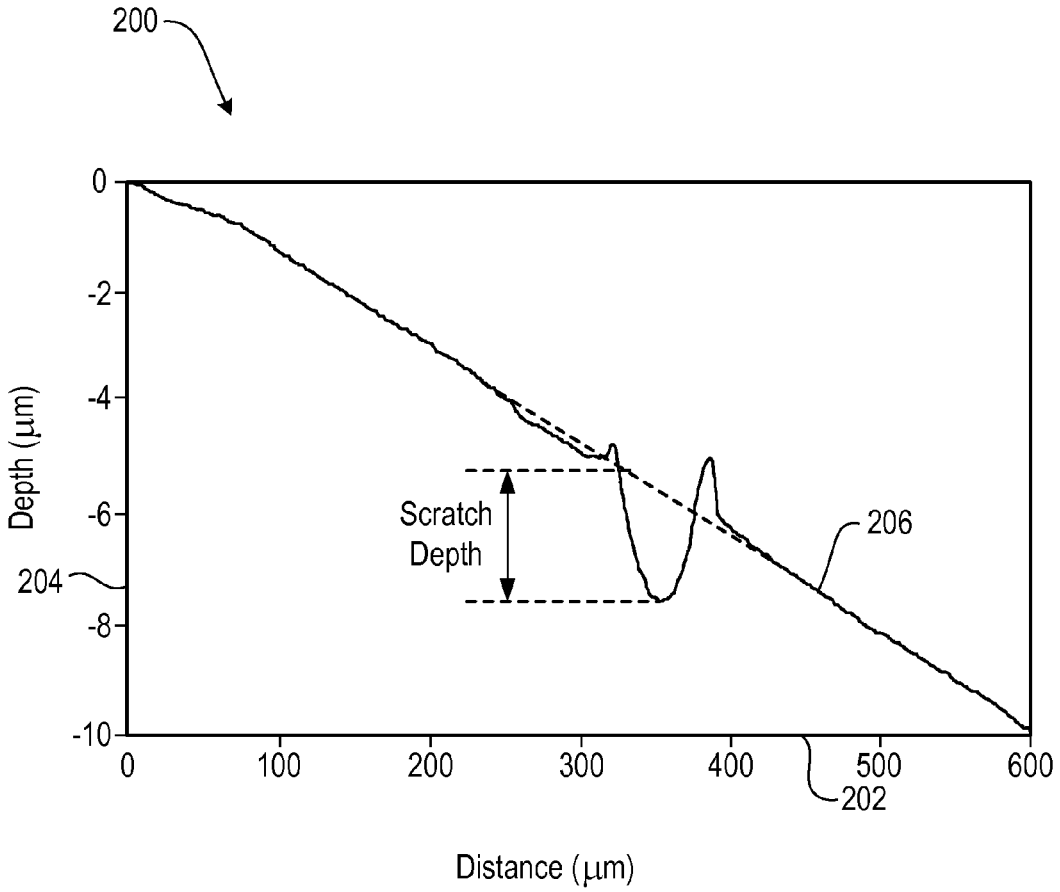
FIG. 2, on coordinates of depth (in μm) and distance (in μm), is a profile of a scratch, in accordance with an example.

FIG. 2 presents an example of the scratch depth measurement for an alcohol-based coating comprising a mixture of monomers (N-vinylpyrrolidone (55 mg), ethoxylated bisphenol A dimethylacrylate (150 mg), trimethylolpropane trimethylacrylate (200 mg), tert-butoxy-3,5,7-trimethylhexanoate (20 mg), fluorene-based copolymer 1 (P1) (60 mg), isopropanol (25 mL), and hexafluoroisopropanol (25 mL)) sprayed onto the OPC surface, cross-linked at 80° C. for 2 hours, and tested using a pyramid-shaped diamond point scratching head under a 50 g load. In plot 200 of FIG. 2, the x-axis 202 is a profile scan distance, measured in micrometers (μm) and the y-axis 204 is the vertical position (also measured in μm) of a Dektak profilometer probe that was not compensated for the sloped surface of a measured sample. Curve 206 shows a typical scratch profile; such measurements were used to develop the scratch depth data depicted in FIG. 3. The downward spike of the plot corresponds to the Dektak probe crossing the scratch line.

Figure 3:
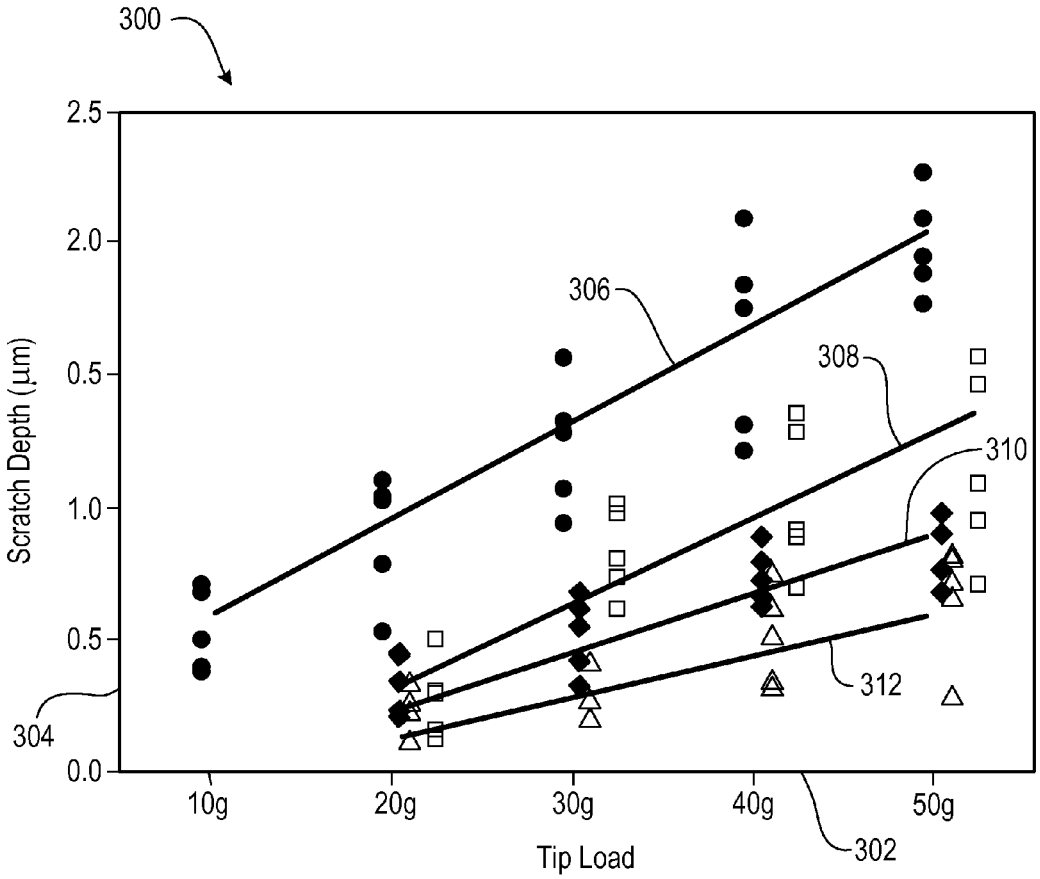
FIG. 3, on coordinates of scratch depth (in μm) and tip load (in g), is a plot that compares the scratch depths of four different OPCs, in accordance with an example.

FIG. 3 compares scratch depths of four different OPCs—(A), (B), (C), and (D) (see Table I for key). In plot 300 of FIG. 3, the x-axis 302 is tip load (in g) and the y-axis 304 is scratch depth (in μm). Curve 306 (●) is the non-coated OPC (A). Curve 308 (□) is the coated OPC, with no nanoparticles (B). Curve 310 (◆) is the coated OPC with 5% NVS $SiO_2$ (C). Curve 312 (Δ) is the coated OPC with 10% NVS $SiO_2$ (D).

It is clear that providing a protective coating that includes inorganic nanoparticles significantly improves scratch resistance. As can be seen, a coating containing 10% of $SiO_2$ nanoparticles (D) had scratch depth about 20× smaller than the non-coated OPC (A), and about 5× smaller than in the case of a coating not having any nanoparticles (B).

The concentration of nanoparticles in the coating layer 128 may range from about 1 to 50 wt %. In some examples, the concentration of nanoparticles may range from about 2 to 20 wt %.

In some examples, the nanoparticles may be substantially uniformly distributed throughout the protective coating 128.

In some examples, the nanoparticles may have a particle size of less than about 100 nm. In other examples, the nanoparticles may have a particle size within a range of about 5 to 50 nm.

The alcohol-soluble coating 128 employed in the practice of the examples may include one or more cross-linkable monomer(s), oligomer(s), polymer(s); one or more cross-linking agent(s); one or more initiator(s); one or more charge transport materials; nanoparticles; and alcohol-based solvent. Any alcohol-soluble charge transport material may be employed in the practice of the examples. One example of such a charge transport material includes cationic fluorene-based copolymer with phosphonium salt functionalized side chains.

The charge transport material may be included in the protective coating 128 to ensure charge transfer between the outer surface 130 of the drum 102 and the charge transport layer 126.

In the discussion that follows, alcohol-soluble coatings that include cationic alternate fluorene-based monomers with phosphonium salt functionalized side chains may be used to coat the OPC and then cross-linked in-situ to form cationic fluorene-based copolymers with phosphonium salt functionalized side chains. However, it will be appreciated that other alcohol-soluble coating may instead be used.

The alcohol-soluble CTMs can coat an existing OPC using an alcohol-based solution process with cross-linked polymer films without damaging the existing CTL 126 in the OPC.

The monomer moieties comprise alcohol-soluble charge transport materials (CTMs) that can be used for an alcohol-based solution OPC coating process. These alcohol-soluble CTMs are based on cationic fluorene-based copolymers with phosphonium salt functionalized side chains. More specifically, these alcohol-soluble CTMs are conjugated cationic copolymers that contain a phosphonium salt in the side chain. These conjugated polymers have extremely high solubility in alcohols, thus permitting coating of the OPC using a solution process based on alcohol solvents. In some examples, the copolymers may be alternate (e.g., A-B-A-B- . . . ).

An organic photoconductor commonly used in electrophotographic applications is a dual layer structure consisting of a thin (about 0.1 to 2 μm) charge generation (CGL) bottom layer 124 and a thick (about 20 μm) charge transport (CTL) top layer 126. Light passes through the transparent CTL 126 and strikes the CGL 124, generating free electrons and holes. Electrons are collected by the electrical ground of the photoreceptor and holes are driven towards to top of the CTL 126 by an applied electrical field. The CTL 126 provides a mechanism for the hole transport towards the surface, at which they are used to neutralize negative surface ions deposited during the pre-charging process. In essence, the CTL 126 consists of a non-conductive organic material (usually a polymer) with charge transport moieties embedded into it. In most cases, the CTL 126 is made of a non-conductive polycarbonate matrix having charge transport moieties in form of conductive organic small molecules or short chain polymers such as aryl hydrazones, aminoaryl heterocycles such as oxadiazole and especially highly conjugated arylamines.

As a consequence of the teachings herein, the CTL 126 may be coated with a protective film 128 having superior resistance against damage occurring during the printing. At the same time, the protective film 128 may exhibit electrical behavior that is compatible with the normal operation of the CTL 126. This means that electrical resistivity of the coating 128 may be comparable with the CTL 126 and it may remain unchanged or, at least, it may change less that the CTL resistivity during the prolonged use of the OPC. In an example, the process of coating the photoconductor with a layer consisting of a mechanically "strong" polymer with uniformly embedded charge transfer moieties employs the respective liquid solvent mixture of monomers, oligomers or even polymers mixed with charge transfer species, followed by deposition of the mixture on the photoconductor and, finally, cross-linking of the polymerizable species. The resulting product is a thin protective layer 128, fully mechanically conformal with the photoconductor and containing substantially uniformly distributed charge transfer moieties. The alcohol-soluble CTMs in the protective coating 128 thus formed may enable charge transfer between the outer surface of the coating and the CTL 126.

In another example, this process can be used to form the entire CTL region 126. In this case, a thin solvent mixture layer is deposited on the CGL film 124. The deposition process can be further controlled by using appropriate surfactants improving wetting of the deposition substrate.

The cross-linked inert polymer network may be formed by combining cross-linkable monomer(s), oligomer(s), and polymer(s), in addition to at least one cross-linking agent and at least one initiator, with the fluorene copolymer and the alcohol-based solvent. The cross-linking agent may be a 2-branch, 3-branch, or 4-branch cross-linker that can be initiated with appropriate energy. Either photo-curable (e.g., ultra-violet curable) or thermally-curable resins may be used. The polymer network is formed from the cross-linkable monomer, oligomer, polymer and the cross-linking agent and initiator; the polymer network comprises a matrix in which the CTM, or the cationic alternate fluorene-based copolymer with phosphonium salt functionalized side chains, is embedded, together with the nanoparticles.

The composition of the solution may include:

- 0.1 to 40 wt % cross-linkable monomer, oligomer, polymer;
- 0.1 to 50 wt % cross-linking agent;
- 0.1 to 20 wt % initiator;
- 0.05 to 40 wt % cationic fluorene-based copolymer with phosphonium salt functionalized side chains;
- 1 to 50 wt % nanoparticles; and
- 0.1 to 20 wt % alcohol-based solvent.

Cross-Linkable Monomer, Oligomer, Polymer:

The liquid solvent mixture may include at least one monomer, which may include any of multifunctional acrylates, styrene, divinyl benzene, iso-cyanates, and di-isocyanates. Examples of multifunctional acrylates include diacrylates, triacrylates, tetraacrylates, and the like. The liquid solvent mixture may include at least one oligomer. For example, acrylate oligomer CN2930, polyester acrylate oligomer CN2302, acrylated polyester oligomer CN299, difunctional polyether methacrylates, etc. The liquid solvent mixture may include at least one functional polymer. Examples include polyester acrylates and polyethylene glycol acrylates. The liquid mixture may alternatively include at least one oligomer or at least one functionalized polymer. By a "functionalized polymer" is a polymer that can be cross-linked with a cross-linking agent (cross-linker).

Examples of cross-linkable monomers include, but are not limited to, N-alkyl acrylamides, N-aryl acrylamides and N-alkoxyalkyl acrylamides. Specific examples include N-methyl acrylamide, N-ethyl acrylamide, N-butyl acrylamide, N,N-dimethyl acrylamide, N,N-dipropyl acrylamide, N-(1,1,2-trimethylpropyl)acrylamide, N-(1,1,3,3-tetramethylbutyl)acrylamide, N-methoxymethyl acrylamide, N-methoxyethyl acrylamide, N-methoxypropyl acrylamide, N-butoxymethyl acrylamide, N-isopropyl acrylamide, N-s-butyl acrylamide, N-t-butyl acrylamide, N-cyclohexyl acrylamide, N-(1,1-dimethyl-3-oxobutyl)acrylamide, N-(2-carboxyethyl)acrylamide, 3-acrylamido-3-methyl butanoic acid, methylene bisacrylamide, N-(3-aminopropyl)acrylamide hydrochloride, N-(3,3-dimethylaminopropyl)acrylamide hydrochloride, N-(1-phthalamidomethyl)acrylamide, sodium N-(1,1-dimethyl-2-sulfoethyl)acrylamide and the corresponding methacrylamides and combinations of two or more of the above mentioned compounds. Further examples, by way of illustration and not limitation, include N-vinyl amides, for example, N-methyl N-vinyl acetamide, N-vinyl acetamide, N-vinyl formamide and N-vinylmethacetamide; N-vinyl cyclic amides, for example, N-vinylpyrrolidone and N-vinyl-3-morpholinone; heterocyclic vinyl amines, for example, N-vinylpyridine, N-vinyloxazolidines, N-vinylpyrimidine, N-vinylpyridazine, N-vinyl-1,2,4-triazine, N-vinyl-1,3,5-triazine, N-vinyl-1,2,3-triazine, N-vinyl-triazole, N-vinyl-imidazole, N-vinylpyrrole and N-vinylpyrazine; polyethylene glycolated acrylates, for example, polyethylene glycol-di(meth)acrylate, ethylene glycol di(meth)acrylate, triethylene glycol di(meth)acrylate and tetraethylene glycol di(meth)acrylate; polyethylene glycolated methacrylates, for example, methylacrylamide glycolate methylether, polyethylene glycol mono(meth)acrylate, methoxypolyethylene glycol mono(meth)acrylate, octoxypolyethylene glycol mono(meth)acrylate and stearoxypolyethylene glycol mono(meth)acrylate; and combinations of two or more of the above mentioned compounds. Further examples, by way of illustration and not limitation, include cationic monomers, for example, N,N-dimethylaminoethyl methacrylate, N,N-dimethyl-aminoethyl acrylate, N,N-dimethylaminopropyl methacrylate, N,N-dimethylaminopropyl acrylate, N,N-dimethylacrylamide, N,N-dimethylmethacrylamide, N,N-dimethylaminoethylacrylamide, N,N-dimethylaminoethylmethacrylamide, N,N-dimethylaminopropylacrylamide, and N,N-dimethylaminopropyl-methacrylamide.

Cross-Linking Agent:

The cross-linking agent may be a 2-branch (e.g., two functionalities), 3-branch (e.g., three functionalities), or 4-branch (e.g., four functionalities) cross-linker that can be initiated with appropriate energy provided by light (UV) or heat. Both photo-curable and thermally-curable formulations have been employed in the practice of the invention.

Examples of polyfunctional cross-linking agents, by way of illustration and not limitation, include multifunctional acrylates such as diacrylates, triacrylates, tetraacrylates, and the like. In some examples, the multifunctional acrylates may include a portion or moiety that functions as a polymer precursor as described hereinbelow. Examples of multifunctional acrylate monomers or oligomers that may be employed as the polyfunctional cross-linking agent (some of which may include a polymer precursor moiety) in the present embodiments, by way of illustration and not limitation, include diacrylates such as propoxylated neopentyl glycol diacrylate (available from Atofina Chemicals, Inc., Philadelphia Pa., as Sartomer SR 9003), 1,6-hexanediol diacrylate (available from Sartomer Company, Inc., Exton, Pa., as Sartomer SR 238), tripropylene glycol diacrylate, dipropylene glycol diacrylate, aliphatic diacrylate oligomer (available from Atofina as CN 132), aliphatic urethane diacrylate (available from Atofina as CN 981), and aromatic urethane diacrylate (available from Atofina as CN 976), triacrylates or higher functionality monomers or oligomers such as amine modified polyether acrylates (available from BASF Corporation as PO 83 F, LR 8869, or LR 8889), trimethylol propane triacrylate (Sartomer SR 351), tris (2-hydroxy ethyl) isocyanurate triacrylate (Sartomer SR 368), aromatic urethane triacrylate (CN 970 from Atofina), dipentaerythritol penta-/hexa-acrylate, pentaerythritol tetraacrylate (Sartomer SR 295), ethoxylated pentaerythritol tetraacrylate (Sartomer SR 494), and dipentaerythritol pentaacrylate (Sartomer SR 399), or mixtures of any of the foregoing. Additional examples of suitable cross-linking additives include chlorinated polyester acrylate (Sartomer CN 2100), amine modified epoxy acrylate (Sartomer CN 2100), aromatic urethane acrylate (Sartomer CN 2901), and polyurethane acrylate (Laromer LR 8949 from BASF).

Other examples of polyfunctional cross-linking agents include, for example, end-capped acrylate moieties present on such oligomers as epoxy-acrylates, polyester-acrylates, acrylate oligomers, polyether acrylates, polyether-urethane acrylates, polyester-urethane acrylates, and polyurethanes endcapped with acrylate moieties such as hydroxyethyl acrylate. Further, the polyurethane oligomer can be prepared utilizing an aliphatic diisocyanate such as hexamethylene diisocyanate, cyclohexane diisocyanate, diisocyclohexylmethane diisocyanate, isophorone diisocyanate, for example. Other examples include isophorone diisocyanate, polyester polyurethane prepared from adipic acid and neopentyl glycol, for example. Specific examples of polyfunctional cross-linking agents that include isocyanate functionalities and acrylate functionalities include materials sold by Sartomer Company such as, for example, CN966-H90, CN964, CN966, CN981, CN982, CN986, Pro1154, and CN301.

Yet other examples of UV-curable or thermally-curable materials that can be used for the polymer matrix with CTMs include those commercially available optical adhesives and electric adhesives from Norland Products such as NOA 60, NOA 61, NOA 63, NOA 65, NOA 68, NOA 68T, NOA 71, NOA 72, NOA 74, NOA 75, NOA 76, NOA 78, NOA 81, NOA83H, NOA 84, NOA 85, NOA 86, NOA 87, NOA 88, NOA 89, NOA 148 AND NOA 1625, NEA 121, NEA 123, NEA 123HGA, NEA 123 K, NEA 123L, NEA 123LHGA, NEA 123M, NEA 123S, NEA 123T, NEA 123THGA, NEA 123TKHGA, NEA 155, NCA 130, NBA 107, NBA 108.

Initiator:

The liquid solvent mixture further may include at least one initiator which may be activated by photo (UV) or thermal energy.

Examples of suitable photo initiators include 2,4,6-trimethyl-benzoyldiphenylphosphine oxide (available as BASF Lucirin TPO), 2,4,6-trimethyl-benzoylethoxyphenylphosphine oxide (available as BASF Lucirin TPO-L), bis(2,4,6-trimethylbenzoyl)-phenyl-phosphine oxide (available as Ciba IRGACURE 819) and other acyl phosphines, 2-benzyl 2-dimethylamino 1-(4-morpholinophenyl)butanone-1 (available as Ciba IRGACURE 369), titanocenes, and isopropylthioxanthone, 1-hydroxy-cyclohexylphenylketone, benzophenone, 2,4,6-trimethylbenzophenone, 4-methylbenzophenone, 2-methyl-1-(4-methylthio)phenyl-2-(4-morphorlinyl)-1-propanone, diphenyl-(2,4,6-trimethylbenzoyl) phosphine oxide, 2,4,6-trimethylbenzoylphenyl-phosphinic acid ethyl ester, oligo-(2-hydroxy-2-methyl-1-(4-(1-methylvinyl)phenyl) propanone), 2-hydroxy-2-methyl-1-phenyl-1-propanone, benzyl-dimethylketal, t-butoxy-3,5,3-trimethylhexane, benzophenone, 2-hydroxy-2-methyl-1-phenyl-1-propanone, anisoin, benzil, camphorquinone, 1-hydroxycyclohexylphenyl ketone, 2-benzyl-2-dimethylamino-1-(4-morph-olinophenyl)-butan-1-one, 2,2-dimethoxy-2-phenylacetophenone, 2-methyl-1-[4-(methylthio) phenyl]-2-(4-morpholinyl)-1-propanone, and mixtures or two or more of the above. Also included are amine synergists such as, for example, ethyl-4-dimethylaminobenzoate and 2-ethylhexyl-4-dimethylamino benzoate. This list is not exhaustive and any known photopolymerization initiator that initiates a free radical reaction upon exposure to a desired wavelength of radiation such as UV light may be used. Combinations of one or more of the above may also be employed in some examples.

Examples of suitable thermal initiators include organic peroxides, azo compounds and inorganic peroxides. Illustrative examples of organic peroxides include diacyl peroxide, peroxycarbonate, and peroxyester. In some examples, the organic peroxide may be a radical initiator such as isobutyl peroxide, lauroyl peroxide, stearyl peroxide, succinic acid peroxide, di-n-propyl peroxydicarbonate, diisopropyl peroxydicarbonate, or bis(4-tert-butylcyclohexyl) peroxydicarbonate. Examples of the inorganic initiators may include ammonium persulfate, sodium persulfate, and potassium persulfate. Combinations of two or more of the above may also be employed.

Nanoparticles:

Examples of nanoparticles and their suppliers include, but are not limited to:

Noanograde LLC, Zurich, Switzerland—$TiO_2$, ITO (indium tin oxide), ZnO, $SiO_2$; nanoparticles; size: 10 nm to 5 μm; solvent: $H_2O$, iso-propanol, ethanol, hexane, toluene.

Nanocs, New York, N.Y., USA—single and multiwall carbon nanotubes; size: up to 50 μm length; solvent: $H_2O$, isopropanol, hexane, ethanol.

Sun Innovations Inc, Fremont, Calif., USA—single and multiwall carbon nanotubes; size: 0.5 to 50 μm; solvent: $H_2O$, isopropanol, ethanol, hexane, dry; $Al_2O_3$, $SiO_2$, $TiO_2$, ZnO, Al-nitride, Si-nitride, Ti-nitride nanoparticles, size: 50 to 500 nm, solvent: $H_2O$, ethanol, isopropanol, hexane.

Ocean State Abrasives, West Warwick, RH, USA—$SiO_2$, $Al_2O_3$ nanoparticles, size: 200 nm to 5 μm; solvent: $H_2O$, methanol, isopropanol.

Sigma-Aldrich, Chicago, Ill., USA—(1) Fe-oxide nanoparticles, size: 10 nm, 100 nm; solvent: $H_2O$, toluene; (2) C(diamond) nanoparticles; size: 100 nm to 1 μm; solvent: isopropanol, hexane; (3) C(graphite) nanoparticles; size: 100 to 200 nm; solvent: dry; $TiO_2$, $Al_2O_3$, $Y_2O_3$.

Alcohol:

The alcohols that can used for OPC coating include common alcohols and perfluoro alcohols, or mixture of an alcohol and perfluoro alcohol, which include, but not limited to methanol, ethanol, propanol, iso-propanol, butanol, 2-butanol, tert-butanol, pentanol, hexanol, trifluoromethanol, pentafluoroethanol, perfluoro isopropanol, and the like.

Fluorene-Based Copolymer:

Turning now to the alcohol-soluble charge transport materials (CTMs), also termed "dopants", several variations are now described. Schemes 1-7 below each describe a general example of this type of alcohol-soluble CTMs based on fluorene copolymers with phosphonium salt functionalized side chains and substituted aromatic derivatives. Examples of the substituted aromatic derivatives include, but are not limited to, dialkyl substituted fluorene derivatives; substituted carbazole derivatives; substituted benzothiadiazole derivatives; substituted phenothiazine derivatives; substituted 2,7-diaminocarbazole derivatives; substituted 1,4-diphenylaminobenzene derivatives; and substituted bisphenylbenzidine derivatives.

Scheme 1 - Fluorene Copolymers with Phosphonium Salt Functionalized Side Chains and Dialkyl Substituted Fluorene Derivatives:

Copolymer 1

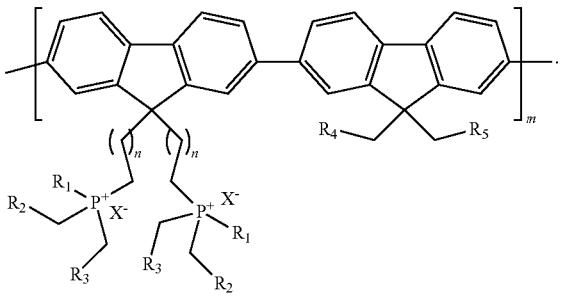

Scheme 2 - Fluorene Copolymers with Phosphonium Salt Functionalized Side Chains and Substituted Carbazole Derivatives:

Copolymer 2

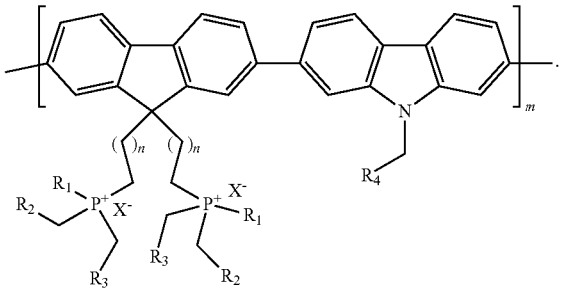

Scheme 3 - Fluorene Copolymers with Phosphonium Salt Functionalized Side Chains and Substituted Benzothiadiazole Derivatives:

Copolymer 3

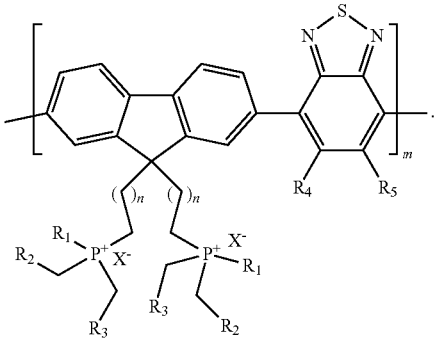

Scheme 4 - Fluorene Copolymers with Phosphonium Salt Functionalized Side Chains and Substituted Phenothiazine Derivatives:

Copolymer 4

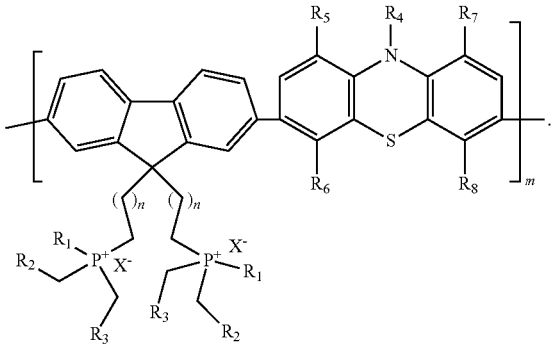

Scheme 5 - Fluorene Copolymers with Phosphonium Salt Functionalized Side Chains and Substituted 2,7-Diaminocarbazole Derivatives:

Copolymer 5

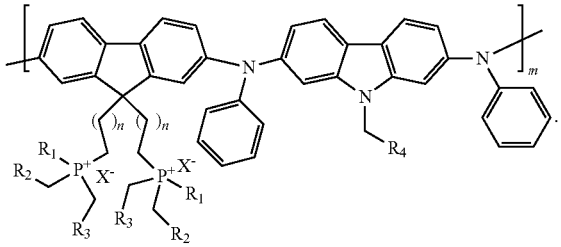

Scheme 6 - Fluorene Copolymers with Phosphonium Salt Functionalized Side Chains and Substituted 1,4-Diphenylaminobenzene Derivatives:

Copolymer 6

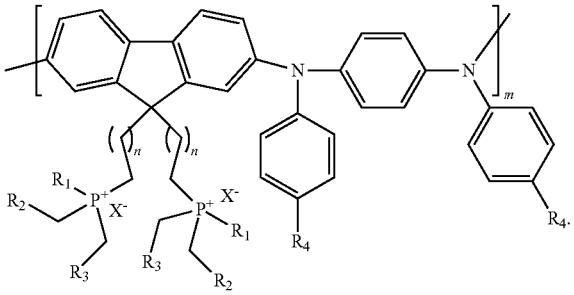

Scheme 7 - Fluorene Copolymers with Phosphonium Salt Functionalized Side Chains and Substituted Bisphenylbenzidine Derivatives:

Copolymer 7

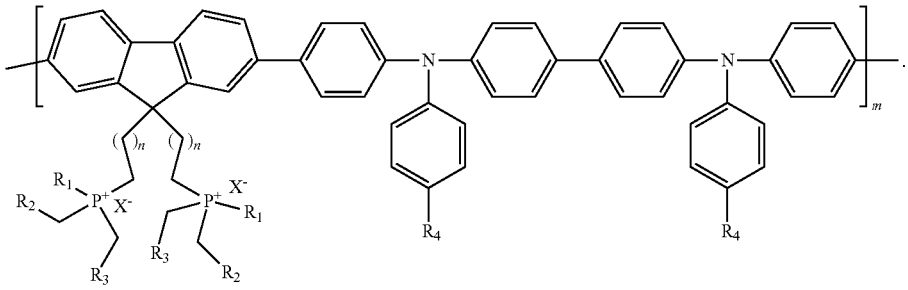

In each of Schemes 1-7, $R_1$, $R_2$, $R_3$, $R_4$, and $R_5$ are each independently selected from the group consisting of C1-C30 alkyl, C1-C30 alkenyl, C1-C30 alkynyl, C1-C30 aryl, C1-C30 alkoxy, C1-C30 phenoxy, C1-C30 thioalkyl, C1-C30 thioaryl, $C(O)OR_6$, $N(R_7)(R_8)$, $C(O)N(R_9)(R_{10})$, F, Cl, Br, $NO_2$, CN, acyl, carboxylate and hydroxy, wherein $R_6$, $R_7$, $R_8$, $R_9$ and $R_{10}$ are each independently selected from the group consisting of hydrogen, C1-C30 alkyl and C1-C30 aryl, and so forth. $R_1$, $R_2$, $R_3$, $R_4$, $R_5$, $R_6$, $R_7$, $R_8$ and $R_9$ may be the same or different.

The letter n is an integer between 1 and 30.

The letter m is an integer between 1 and 5,000.

The letter X represents any anion such as Br, $Cl^-$, $I^-$, tetrafluoroborate, tetraphenyl borate, and the like.

Formation of Protective Layer 128:

The liquid solution may be formed by combining the various components (cross-linkable monomer, oligomer, polymer plus cross-linking agent, initiator, fluorene copolymer, nanoparticles, and alcohol solvent. The liquid solution may then be applied to the OPC, forming a thin, substantially uniform coating (with the help of one or more surfactants), and the solvent allowed to evaporate. In some examples, the coating 128 may be less than about 2 μm, while in other examples, somewhat thicker coatings with a high enough electrical conductivity and charge mobility may be employed. Finally, the polymerizable components of the liquid mixture are cross-linked in-situ, forming a strong, mechanically conformal protective coating consisting of a polymer thin layer matrix with a uniformly distributed added species (charge transport moieties, namely, the fluorene copolymer) and the nanoparticles.

There are various methods in which the surface of OPC may be covered with the thin layer of the cross-linked polymer with the fluorene copolymer hole-transport material embedded into it. This may be accomplished by coating the OPC with a thin film liquid formulation including a monomer, a hole-transport material (dopant), an initiator, a cross-linker, and wetting agents, including solvent, together with nanoparticles. For example, the liquid formulation may be sprayed onto the surface of OPC and a blade, such as a plastic blade, may be used to achieve the desired uniform thickness of the liquid film. Alternatively, a uniformly thick liquid layer may be applied with a roller.

After solvent evaporation, the monomer coating may be polymerized in-situ by applying UV illumination or heat, depending on the type of initiator used.

Alternatively, polymerization may be accomplished by mounting the photoconductor in a press and commencing printing. UV and heat exposure during the printing process (especially in the case of using a charge roller that produces copious amounts of UV radiation) is sufficient to complete polymerization within the first few tens to hundreds of printed pages.

A combination of partial polymerization before mounting the photoconductor in a press followed by continuation of the polymerization during press operation may also be used.

If subjected to thermal cross-linking, the mixture on the charge generation layer may be cross-linked by exposure to heat for a period of time. Typically, the mixture may be cross-linked at a temperature within a range of about 25° to 120° C. for about 1 to 50 hours. Shorter curing times may be associated with higher temperatures.

If subjected to photo cross-linking, the mixture on the charge generation layer may be cross-linked by exposure to ultraviolet (UV) radiation for a period of time. Typically, the mixture may be cross-linked by UV radiation within a range of about 255 to 385 nm for about 1 to 60 minutes. Shorter curing times may be associated with shorter wavelength and with higher intensity.

In any event, the polymerization may be performed in air or in an inert ambient environment.

Controlled polymerization (by varying time, UV exposure or temperature) can be used to tune the mechanical strength of a protective layer. Further control of this parameter can be achieved by introducing additional mechanically resistant additives into deposited liquid formulation. Desired electrical conductivity within the protective film can be achieved by detailed control of the monomer-to-hole transport material ratio in the mixture.

Precise control of the layer thickness is achieved by adjusting the solvent-to-matrix polymer species ratio in the mixture before deposition with a given coating technique (for a given thickness of the deposited liquid film, a higher solvent-to-polymer ratio means thinner final coating). The polymer concentration may be in a range of about 0.1 to 10 wt % in some examples and about 0.25 to 2 wt % in other examples. Similarly, a larger ratio of the charge transport materials to the matrix polymer species may result in a higher electrical conductivity of the final coating. The dopant (charge transport material) concentration in the solvent may be in a range of about 0.05 to 0.5 wt % in some examples and about 0.075 to 0.25 wt % in other examples.

In summary, a novel strategy is provided to improve the lifetime and performance of organic photoconductors (OPCs) by using nanoparticles in an in-situ polymerized matrix formed as a protective coating 128 on the charge transport layer 126. The protective coating provides significantly increased scratch resistance on an OPC, thereby providing much longer OPC lifetime and corresponding lower printing cost. The improvement disclosed herein may be incorporated into already existing solutions. Finally, the use of the protective coating disclosed herein is low cost, and adds pennies to the cost of the OPC.

What is claimed is:

1. An organic photoconductor including:

a conductive substrate;

a charge generation layer formed on the conductive substrate;

a charge transport layer formed on the charge generation layer; and a protective coating formed on the charge transport layer, the protective coating comprising inorganic nanoparticles incorporated in an in-situ cross-linked polymer matrix together with an alcohol-soluble hole transport material embedded in the in-situ cross-linked polymer, wherein the hole transport material comprises a cationic alternating fluorene-based copolymer with phosphonium salt functionalized side chains.

2. The organic photoconductor of claim 1 wherein the alcohol soluble hole transport material embedded in the in-situ cross-linked polymer comprises a copolymer selected from the group consisting of fluorene copolymers with phosphonium salt functionalized side chains and dialkyl substituted fluorene derivatives; fluorene copolymers with phosphonium salt functionalized side chains and substituted carbazole derivatives; fluorene copolymers with phosphonium salt functionalized side chains and substituted benzothiadiazole derivatives; fluorene copolymers with phosphonium salt functionalized side chains and substituted phenothiazine derivatives; fluorene copolymers with phosphonium salt functionalized side chains and substituted 2,7-diaminocarbazole derivatives; fluorene copolymers with phosphonium salt functionalized side chains and substituted 1,4-diphenylaminobenzene derivatives; and fluorene copolymers with phosphonium salt functionalized side chains and substituted bisphenylbenzidine derivatives.

3. The organic photoconductor of claim 1 wherein the, inorganic nanoparticles have a concentration in the protective coating within a range of about 1 to 50 wt %.

4. The organic photoconductor of claim 1 wherein the, inorganic nanoparticles have a particle size of less than about 100 nm.

5. The organic photoconductor of claim 1, wherein the protective coating is formed from a solution including:

0.1 to 40 wt % cross-linkable monomer, oligomer, or polymer;

0.1 to 50 wt % cross-linking agent;

0.1 to 20 wt % initiator;

0.05 to 40 wt % cationic alternating fluorene-based copolymer with phosphonium salt functionalized side chains;

1 to 50 wt % of the inorganic nanoparticles; and 0.1 to 20 wt % alcohol-based solvent.

6. The organic photoconductor of claim 5 wherein the cross-linkable monomer is selected from the group consisting of N-alkyl acrylamides, N-aryl acrylamides, N-alkoxyalkyl acrylamides, N-alkyl methacrylamides, N-aryl methacrylamides, N-alkoxyalkyl acrylamides, N-vinyl amides, N-vinyl cyclic amides, heterocyclic vinyl amines, polyethylene glycolated acrylates, polyethylene glycolated methacrylates, and cationic monomers.

7. The organic photoconductor of claim 5 wherein the cross-linking agent is selected from the group consisting of 2-branch, 3-branch, and 4-branch cross-linkers that can be initiated with energy provided by heat or UV.

8. The organic photoconductor of claim 5 wherein the initiator is selected from the group consisting of thermally-activated initiators and photo-activated initiators.

9. The organic photoconductor of claim 5 wherein the fluorene-based copolymer is selected from the group consisting of fluorene copolymers with phosphonium salt functionalized side chains and dialkyl substituted fluorene derivatives; fluorene copolymers with phosphonium salt functionalized side chains and substituted carbazole derivatives; fluorene copolymers with phosphonium salt functionalized side chains and substituted benzothiadiazole derivatives; fluorene copolymers with phosphonium salt functionalized side chains and substituted phenothiazine derivatives; fluorene copolymers with phosphonium salt functionalized side chains and substituted 2,7-diaminocarbazole derivatives; fluorene copolymers with phosphonium salt functionalized side chains and substituted 1,4-diphenylaminobenzene derivatives; and fluorene copolymers with phosphonium salt functionalized side chains and substituted bisphenylbenzidine derivatives.

10. The organic photoconductor of claim 5 wherein the solvent is selected from the group consisting of methanol, ethanol, isopropanol, propanol, butanol, 2-butanol, tert-butanol, pentanol, hexanol, perfluoro alcohols, and a mixture of an alcohol and a perfluoro alcohol.

11. A printer including an organic photoconductor drum, the organic photoconductor including:

a conductive substrate;

a charge generation layer formed on the conductive substrate;

a charge transport layer formed on the charge generation layer; and a protective coating formed on the charge transport layer, the protective coating comprising inorganic nanoparticles incorporated in an in-situ cross-linked polymer matrix, wherein the protective coating comprises the inorganic nanoparticles incorporated in the in-situ cross-linked polymer matrix together with an alcohol-soluble hole transport material embedded in the in-situ cross-linked polymer, wherein the hole transport material is a cationic alternating fluorene-based copolymer with phosphonium salt functionalized side chains.

12. The printer of claim 11, wherein the in-situ cross-linked polymer matrix, which also incorporates alcohol soluble cross-linkers and photo initiators.

* * * * *